US005664769A

United States Patent [19]

Sadinsky et al.

[11] Patent Number: 5,664,769

[45] Date of Patent: Sep. 9, 1997

[54] SWIMMING POOL AND SPA TENSIONED PROTECTIVE FENCE WITH AUTO LOCKABLE GATE AND METHOD OF INSTALLATION THEREOF

[75] Inventors: Steven E. Sadinsky, Van Nuys; Chen L. Yu, Westlake Village, both of Calif.

[73] Assignee: Stephen E. Sadinsky, Van Nuys, Calif.

[21] Appl. No.: 746,652

[22] Filed: Nov. 13, 1996

Related U.S. Application Data

[60] Provisional application No. 60/020,477 June 13, 1996

[51] Int. Cl.[6] ..... E04H 17/00; E04H 4/14

[52] U.S. Cl. ..... 256/73; 256/25; 4/504

[58] Field of Search ..... 256/26, 25, 73; 49/381, 386; 4/496, 504, 506

[56] References Cited

U.S. PATENT DOCUMENTS

| | | | |
|---|---|---|---|
| 710,051 | 9/1902 | Fullam . | |
| 851,936 | 4/1907 | Hendrich | 256/73 X |
| 2,852,876 | 9/1958 | Blum . | |
| 3,469,822 | 9/1969 | O'Brien | 256/25 |
| 4,122,630 | 10/1978 | Parisien . | |
| 4,122,631 | 10/1978 | Batcheller . | |
| 4,662,111 | 5/1987 | Romberg . | |
| 5,063,876 | 11/1991 | Harris | 256/25 X |
| 5,192,054 | 3/1993 | Sharp . | |
| 5,354,036 | 10/1994 | Brown | 256/25 |
| 5,362,116 | 11/1994 | Doyle et al. | 292/251.5 X |
| 5,553,833 | 9/1996 | Bohen | 256/19 X |

*Primary Examiner*—Anthony Knight
*Attorney, Agent, or Firm*—Wagner & Middlebrook

[57] ABSTRACT

A gate assembly for tensioned fences, particularly those which encircle home swimming pools and are removable for swimming pool use. The gate in its preferred form is "U" shaped with no rigid bar at the top and has the space between the bars of the gate filled with tensioned mesh fabric similar to the tensioned fence. The gate is supported by poles on each edge which provides spring closed hinging on one edge and an automatic latch at the opposite edge. The poles are in fact pairs of poles at each side which together react to the tension of the fence without transferring the fence tension to the gate. In one form, the two poles at each edge are rigidly connected by bars which define a truss. The gate supporting poles are secured to the pole decking as by insertion in drilled holes which are at cant angles in the order of 5° away from the direction of the fence tension. A process for installing the fence and gate is described.

19 Claims, 4 Drawing Sheets

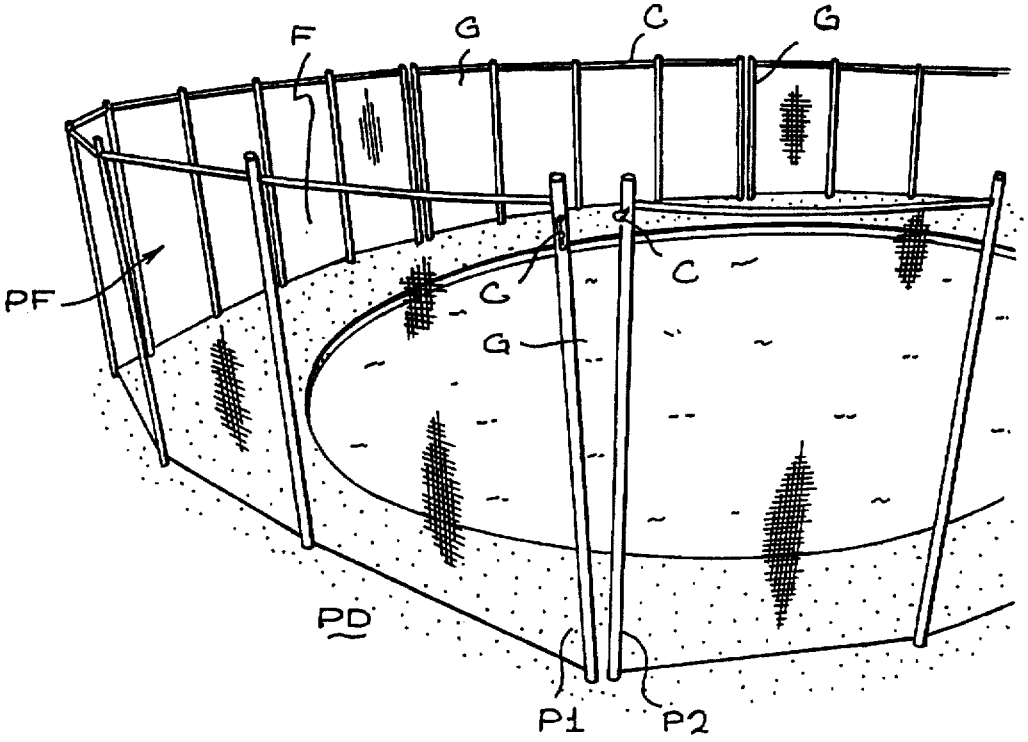
FIG. 1
PRIOR ART
FIG. 2
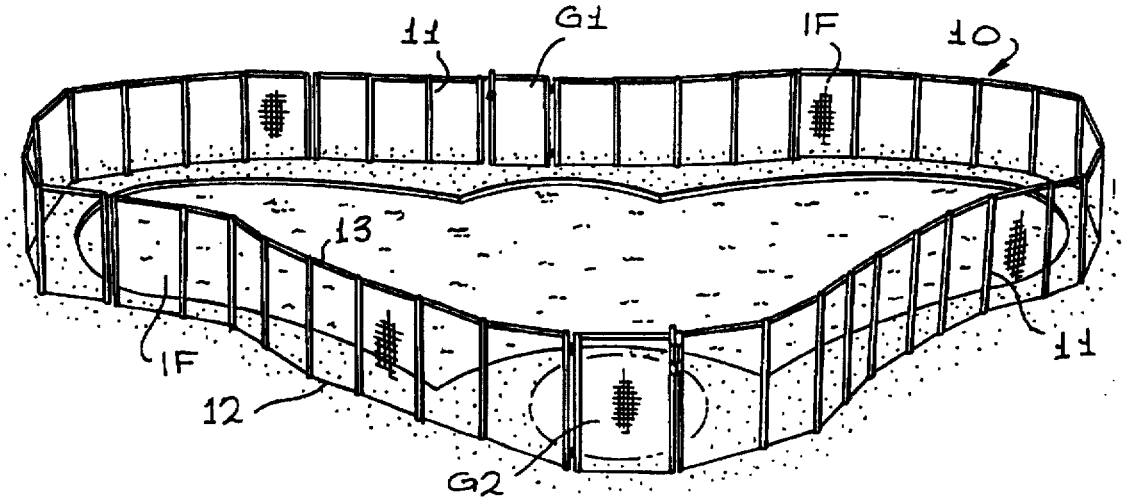

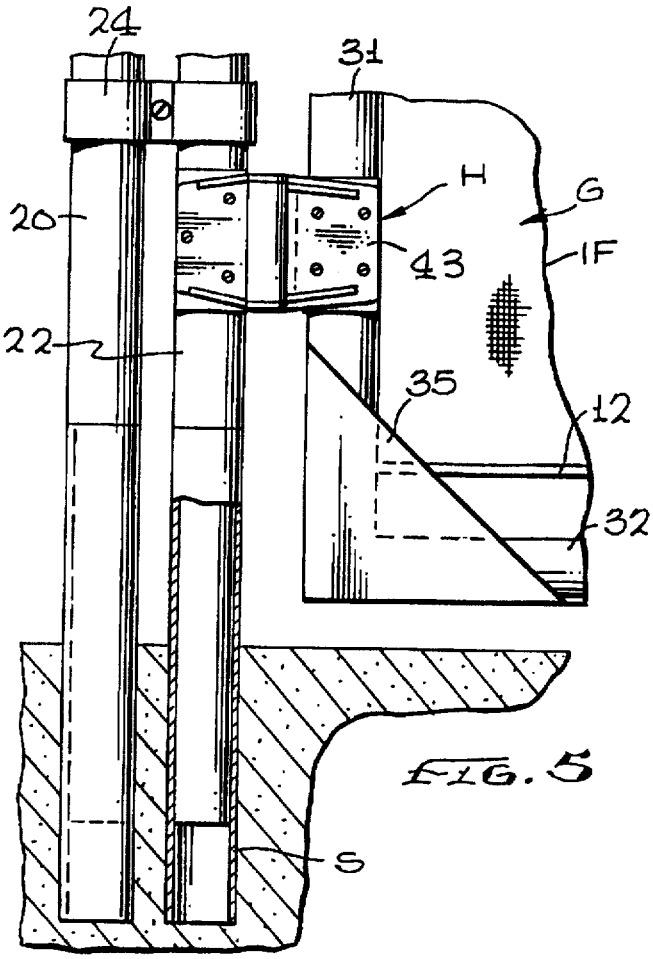
FIG. 5
FIG. 6
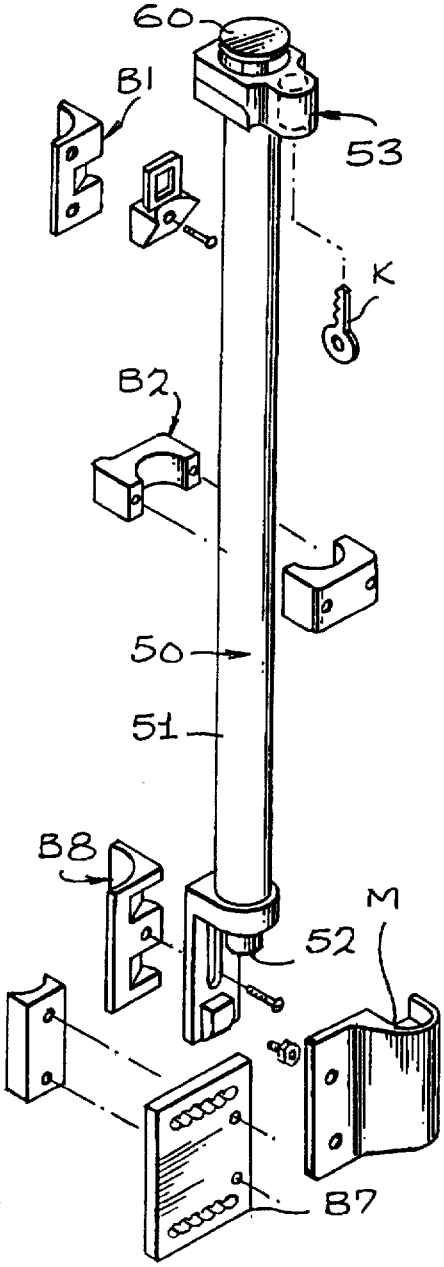
FIG. 8
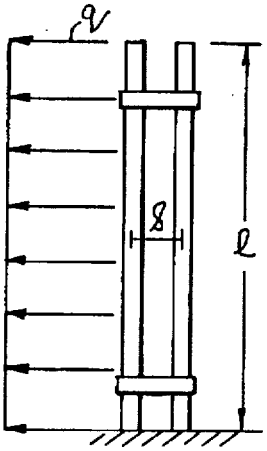
FIG. 9
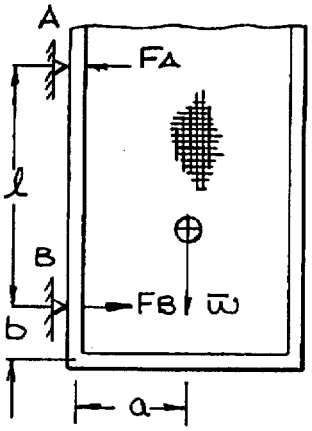

FIG. 10
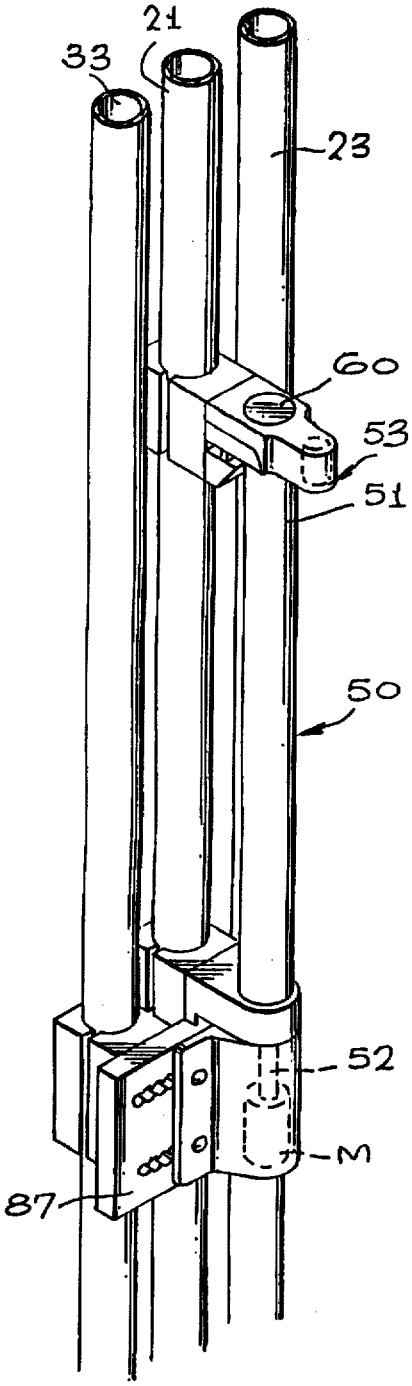
FIG. 11
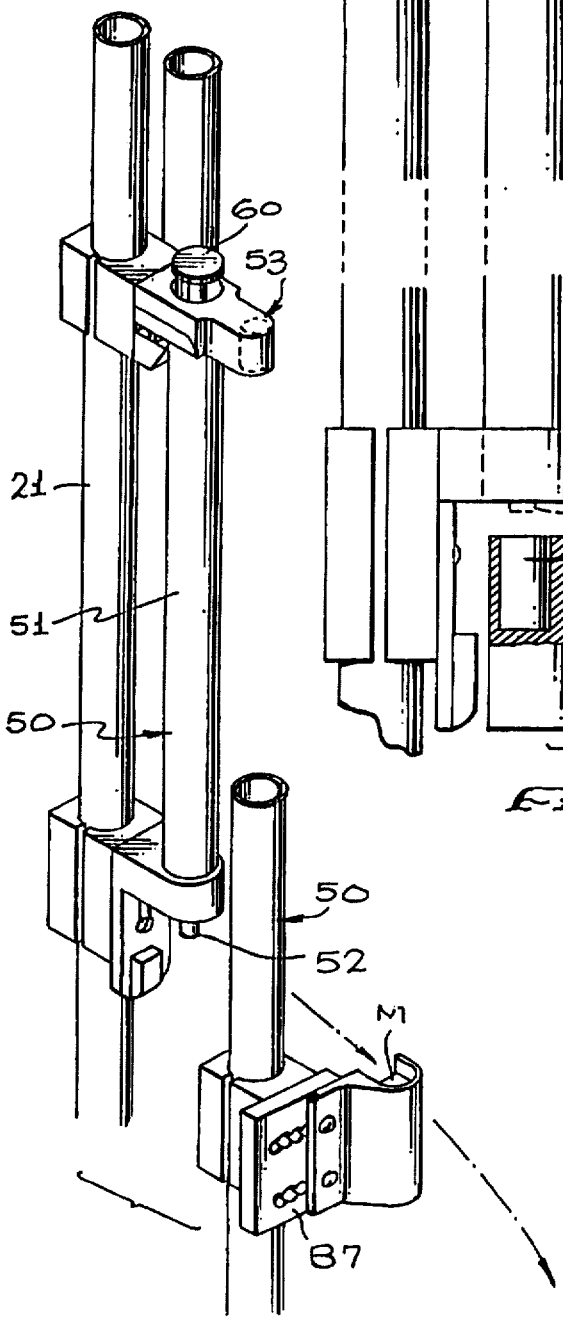
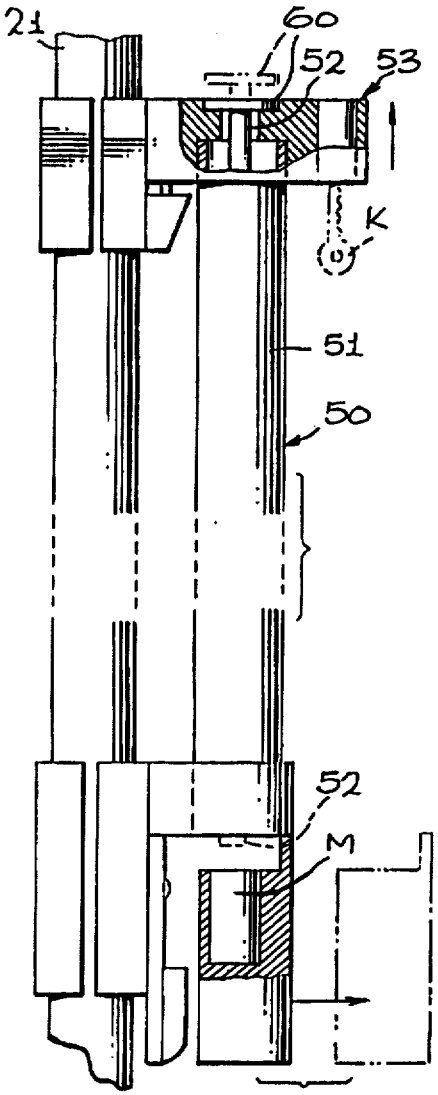
FIG. 12

SWIMMING POOL AND SPA TENSIONED PROTECTIVE FENCE WITH AUTO LOCKABLE GATE AND METHOD OF INSTALLATION THEREOF

REFERENCE TO RELATED APPLICATION

This application is a non provisional application based upon and claims benefit of U.S. Provisional Application No. 60/020,477 filed Jun. 13, 1996.

BACKGROUND OF THE INVENTION

In recent years, the need has been recognized for a type of swimming pool fence which is difficult if not impossible for a small child to climb, is weather resistant and yet may be removed for uninterrupted use of the swimming pool. These fences employ a number of rigid or slightly flexible poles of steel, aluminum or fiberglass which are set in unobtrusive holes in the pool decking approximately two feet from the edge of the pool. These poles are located at approximately 30–48 inch spacing.

Tensioned between the poles is a mesh screen having a binding top and bottom and sufficient tensile strength so that one cannot enlarge the mesh openings to force their way through the fence nor provide any place for grasp or foothold for a child to climb the fence. We have found that the bound upper edge of the fence prevents fraying of the mesh but does not provide a hand hold or sufficient rigidity to aid a child to climb over the fence even if the child reaches the top of the fence. The instability of the top binding acts as a deterrent for the child even if they touch the top of the fence.

The fence may be opened to allow swimmers to enter and leave the pool area by unlatching a section which acts as a gate usually with a spring loaded hook and eye fastener and then by lifting one pole out of its deck socket. The pole must be reinserted and the latch hooked for each entry and departure from the pool area.

When the pool is to be used without the fence, each of the poles are pulled in sequence from their socket and the fabric fencing material and poles rolled to form a compact structure. Reassembly of the fence starts by inserting the first pole, hooking it to some rigid structure and extending each pole in the section in sequence to another rigid structure or back to the original pole to complete a closed circuit. Each section is then tensioned with the fastener connecting each fence section to the next section.

One of the most serious limitations in this type of fence is the lack of a suitable gate. The existing fence opening gates are difficult for persons of smaller height or strength to pull the gate pole out and reinsert it since the entire fence by its very nature is tensioned.

Typically, the fence is erected in sections, e.g., 10–12 feet in length and tensioned together at the top by a fastener such as an additional spring locked hook and eye fastener.

BRIEF DESCRIPTION OF THE INVENTION

Faced with this state of the art, we determined that it should be possible to produce a tension protective fence with a gate presenting the same overall appearance and degree of safety with far superior accessibility for adults but presenting extreme difficulty for a child to defeat the gate and fence.

Likewise, we have found that it is possible to produce a gate having sufficient rigidity while still maintaining extreme difficulty for a child to climb the gate.

We have accomplished these objectives employing a conventional tensioned pool fence with a multiple pole truss arrangement at each side of the intended gate opening with the multiple poles forming a rigid truss yet having hardly any additional size than the single pole and arranging the poles to be canted sufficiently to provide free standing end posts defining a gate opening. Multiple poles adjacent to the gate relieve the gate from the tension present in the fence. We have designed a unique gate with a secure automatic closure and automatic locking and key locking as well.

This is all accomplished in cooperation with a gate in the preferred form of frame of a "U" shape with a bottom bar side rails and angle bracing rods or gusset plates for reinforcement and a fabric fence material matching the fence extending between the legs of the gate. In its preferred form, there is no top bar so that the gate itself presents no easier access for a child than any section of the fence proper.

Spring closing hinges contained within a smooth housing which provides minimum climbing risk are used for the gate. The closure includes a magnetic latch with a strong magnet located either on the gate or the side post so that the gate will be drawn fully closed and latched whenever it reaches a near closed position. A key lock also is provided so that the full gate can be easily locked with a key at any time. The gate assembly may be removed when the entire fence is removed for unobstructed use and easily installed in just a few minutes time.

BRIEF DESCRIPTION OF THE DRAWING

This invention may be more clearly understood with the following detailed description and by reference to the drawings in which:

FIG. 1 is a perspective view of a prior art fence and gate opening;

FIG. 2 is a perspective view of a swimming pool fence installation incorporating two gates of this invention;

FIG. 5 is a fragmentary sectional view of the hinged side of the base of the gate of FIG. 3;

FIG. 6 is an exploded view of the latch assembly of FIG. 3;

FIG. 8 is a force diagram of the gate post assembly of FIG. 3;

FIG. 9 is a force diagram of the gate of FIG. 3;

FIG. 10 is a perspective view of the gate latch assembly of FIG. 3 in a closed and locked position;

FIG. 11 is a perspective view of the gate latch assembly of FIG. 3 in an open and unlocked position; and FIG. 12 a side elevational view of the gate latch of FIG. 3 in a latched position.

DETAILED DESCRIPTION OF THE INVENTION

FIG. 1 is representative of a prior art tensioned pool fence PF including particularly the gate region G after a hook and eye closure C has been opened. The fence poles P1 and P2 are slightly bowed outward owing to the tension on each section of the fence.

The fact that the entire fence is tensioned when closed allows the poles to be relatively small in diameter, e.g., O.D. 1" and manufactured of steel, aluminum or fiberglass tubing. This characteristic makes opening of a selection or installation of a gate, heretofore, incompatible with normal fence integrity.

The pole P1 will normally stay in position and pole P2 may be lifted upward out of its socket S in the pool decking and folded back to allow entrance and departure from the pool area. The fabric F has mesh with openings as small as ⅛" with vinyl coated threads to provide a clear view through the fence to observe the pool condition but so small that even the smallest child can not insert their fingers in the openings of the mesh.

In order to open the gate portion of the tensioned fence PF, an adult must draw the poles P1 and P2 together sufficiently to relax the load on the hook closure C and release it and then in opposition to the pool fence tension must draw the pool pole P2 out of its socket S in the pool decking PD. We have found that individuals with limited strength or manipulative ability have difficulty with these two steps. As shown in FIG. 1, the first step of releasing the hook and eye closure C has been completed. To close the gate, the steps are reversed by an adult.

Now referring to FIG. 2, the entire pool fence 10 employing this invention is shown with two gates, G1 as a patio gate entrance and G2 as a spa gate entrance. The gates G1 and G2 present virtually the same appearance as the tension fence PF above which is made up principally of standard poles 11 and an improved fabric IF with each intersection knot tied and all vinyl coated. The fence 10 has a lower binding 12 and an upper binding 13 and is installed with typically 15–20 lbs tension uniformly from top to bottom around its entire periphery. The openings in the fence 10 are preferably smaller than ¼" and of insufficient size to allow the child to place their fingers or toes in the fence. The top and bottom binding 12 and 13 do not provide any effective foot hold or hand hold to allow lifting a child's body upward.

Figure 3:
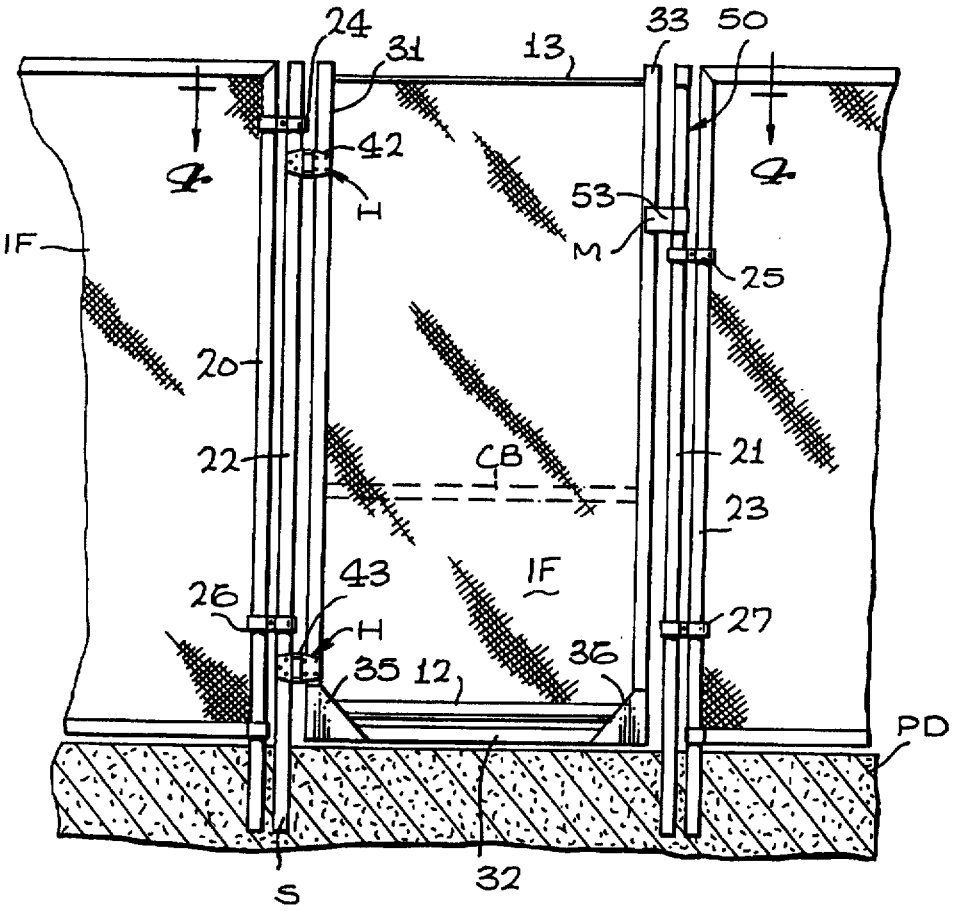
FIG. 3 is a front elevational view of the gate of this invention with a portion of the pool deck in section.

The gates G1 and G2 may be seen better in FIG. 3 with the pair of poles 20, 22 on one side and 21, 23 on the other side, each pair interconnected by respective cross members 24 and 26 on the hinged side and 25, 27 on the latched side. The net result is that each of the 20 and 22 poles with their cross members 21, 23 form a vertical truss with each pole 20 & 22 in its respective socket S in the deck PD. The deck sockets S are drilled at a cant angle of approximately five degrees toward the gate so that fence 10 is tensioned while the gate opening GO is without any tension from the fence 10 transferred to the gate G. The poles 20 and 22 on the hinged side each bend imperceptively to the vertical by the fence tension from the left. The same is true for the poles 21 and 23 responding to fence tension from the right.

The calculations establish that the dual truss pole of FIGS. 2, 3 and 8 will remain essentially vertical when subject to the unidirectional fabric load of the fence. The dual poles isolate the gate from fence tension. A deflection of 0.054" at the top of a 60 inch pole is calculated. In practice, the pole sockets for the gate pole trusses are drilled at approximately a 5 degree cant away from the fence. Therefore, any deflection of the poles toward the tensioned force is fully compensated. In fact, any slight cant of the gate at the hinged side aids in closing Therefore three closing forces are present, the spring force, gravity and magnetic attraction of the latch. The spring force of the hinges, of course, is the primary closing force.

Figure 4:
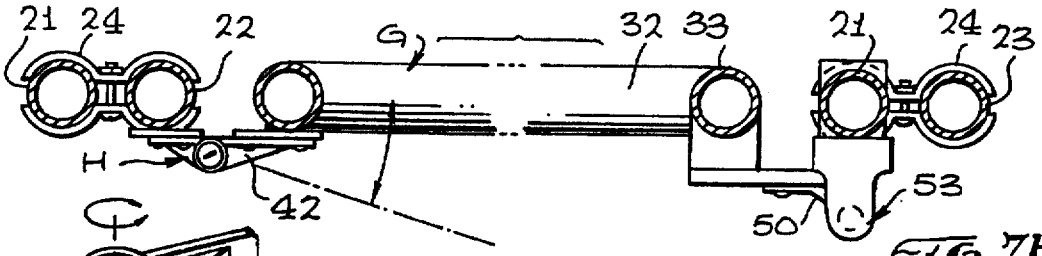
FIG. 4 is a top sectional view of the gate region of the fence of FIG. 3 taken along fine 4—4 of FIG. 3.

Now further referring to FIG. 3, in connection with FIGS. 4 and 5, the gates G1 and G2 which are made up, preferably of three frame members including a hinged upright 31, base member 32 and a latched upright 33. Preferably, the base 32 and uprights 31 and 33 are fabricated of steel or aluminum tubing and are attached by screws or other means to the upright 31 and 33 and base 32 welded or brazed into a unitary structure with reinforcing angled rods or gusset plates 35, 36 at the joints between the base member 32 and the uprights 31 and 32. The cross brace CB shown in dashed lines might be used for bending strength provided it is on the pool side of the gate and well below the top of the gate fabric. Tensioned between the uprights is a section of improved fencing material IF with edge bindings 12 and 13 similar to the fence material.

To provide uniformity of appearance and freedom from any rigid top cross bar structure on the gate, the U shaped gate is employed as shown in FIG. 3. It is important that the gate G have sufficient strength and rigidity to operate properly for years. It also resists any failure if a child would attempt to climb it. We have designed such a gate which will not fail if weights equivalent to a 70 pound youngster are applied to the gate.

Figure 7B:
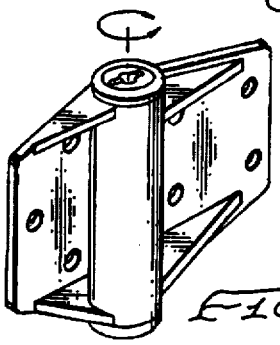
FIG. 7B is a front elevational view of a hinge assembly of FIG. 3 partly broken away to show the interior spring.
Figure 7:
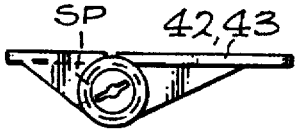
FIG. 7 is a perspective view of a hinge of FIG. 3.
Figure 7A:
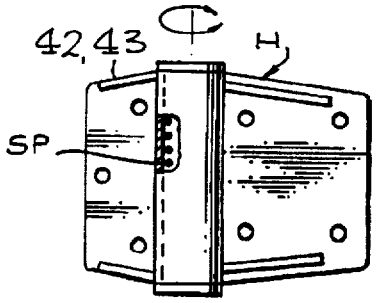
FIG. 7A is a top plan view of the hinge of FIG. 3.

Corrosion resistant hinges H best seen in FIGS. 7, 7*a* and 7B, having internal springs SP of FIG. 7B for self closing spring mount the upright 31 to the adjacent pole 22.

The opening side of the gate G1 includes a smooth surfaced latch member 50 secured to pole 21 as best seen in FIGS. 6 and 10–12 and a gate latch assembly 53 carrying a magnet M on the upright adjacent gate pole 33 of FIG. 4. The latch member 50 includes a tube 51 containing a ferromagnetic bar 52 extending along a substantial length of the pole 21 within tube 51 to provide a latching element for the magnet M. The magnet M tends to urge bar 52 toward its socket and is of sufficient strength so that it will draw the gate G closed whenever the gate G is drawn by spring hinges 42 and 43 to an opening of one to two inches. The spring hinges 42 and 43 add sufficient spring tension to securely close the gate G wherever the open gate G is released. Brackets B1 and B2 secure the latch assembly to the upright post 21 and the brackets B7 and B8 secure the magnet M and its housing to the gate upright 33.

The top of the magnetic latch 50 includes a button type handle 60 and a key lock 53 so that the pool gate G not only is closed by the magnet M but may be opened by an adult by lifting handle 60 to disengage the rod 52 from the socket of magnet M and also may be mechanically locked in the closed position by key K.

The method of this invention includes the steps of:

attaching flexible mesh fencing IF to a series of poles P1–Pn at selected intervals;

securing the poles P1–Pn to a pool deck PD at intervals which tension the mesh fencing IF;

securing two pair of poles 20, 22 and 21, 23 together to form a tension absorbing support structure, one at each edge of a gate in the fence 10;

fabricating a gate including a pair of side rails 31 and 33 and a cross rail 32 and tensioned mesh IF extending between the side rails;

pivotally connecting one gate side rail 31 to one of the pairs of poles defining the gate opening; and releasable connecting the second of the pair of side rails 33 of the gate to one of the second pair of poles defining the gate opening.

The features of our invention are as follows:

1. It provides a tensioned pool protective fence with a tensioned fabric gate in a non tensioned gate opening;
2. Provides a gate which has a degree of protection of a child climbing on it comparable to the fence itself;
3. Provides automatic closing and latching of the gate and locking as well;
4. Provides a design of a gate which provides few if any hand holds or foot grips for any child attempting to climb the fence.
5. Provides a pool security gate with no top gate bar.
6. Openable only at the top of the gate post by a manually dexterous person.

The above described embodiments of the present invention are merely descriptive of its principles and are not to be considered limiting. The scope of the present invention instead shall be determined from the scope of the following claims including their equivalents.

We claim:

1. A lightweight fence and gate for swimming pools surrounded by a deck comprising a plurality of poles adapted to be inserted into the pool decking adjacent said pool;

a mesh screen tensioned between said poles having top and bottom bindings;

a gate in said fence including a frame having a pair of spaced upright support members, a first horizontal brace for spacing the upright support members and a length of mesh screen tensioned between said upright support members;

support means capable of withstanding lateral tension forces of said screen for supporting and latching said gate;

hinges secured to said support means on one side of said gate; and a latch device secured to said gate and to said support means on the opposite side of said gate.

2. A lightweight fence and gate as claimed in claim 1 wherein said hinges have internal gate self closing springs.

3. A lightweight fence and gate as claimed in claim 1 wherein said latch device includes a magnetic latch tending to pull said gate closed and latched.

4. A lightweight fence and gate as claimed in claim 1 wherein said support means includes on each side of said gate a pair of poles inserted into the pool deck in close proximity to each other with cross members attached to both of said pair of poles.

5. A lightweight fence and gate as claimed in claim 4 wherein said poles are secured to the pool deck at a small angle opposing the tension force of said mesh screen.

6. A lightweight fence and gate as claimed in claim 4 wherein said gate includes a generally U-shaped frame opening upwardly with said first horizontal brace secured to the lower ends of said upright support members and a second horizontal brace secured to said upright support members on the pool side of said mesh screen at a height well below the top of said gate fabric.

7. A lightweight fence and gate as claimed in claim 4 wherein said latch device includes a magnetic latch tending to pull said gate closed and latched.

8. A lightweight fence and gate as claimed in claim 4 wherein said latch device includes a ferromagnetic rod carried on one of said poles of said support means and said gate and a magnet having a socket secured to the other of said poles of said support means and said gate for receiving said ferromagnetic rod.

9. A lightweight fence and gate as claimed in claim 8 wherein said latch device includes manual means for disengaging said ferromagnetic rod from said socket.

10. A lightweight fence and gate as claimed in claim 9 wherein said latch means includes a key operated lock for preventing said ferromagnetic rod from being disengaged from said socket.

11. A lightweight fence and gate for swimming pools surrounded by a deck comprising a plurality of poles adapted to be inserted into said deck adjacent said pool;

a first length of mesh screen tensioned between said poles defining the pool fence;

a gate in said fence including a generally U-shaped frame opening upwardly having a pair of spaced upright support members and a second length of mesh screen tensioned between said upright support members of said gate; and support means to which said first length of mesh screen is attached for supporting said fence and gate and latching said gate including a truss structure capable of isolating the lateral tension forces of said first length of mesh screen on opposite sides of said gate.

12. A lightweight fence and gate as claimed in claim 11 wherein said poles are set in openings in said pool deck at a small angle to the vertical opposing the tension force of said first length of mesh screen.

13. A lightweight fence and gate as claimed in claim 11 wherein said latch device includes a ferromagnetic rod carried on one of said truss structure and said gate and a magnet having a socket secured to the other of said truss structure and said gate for receiving said rod.

14. A lightweight fence and gate as claimed in claim 13 wherein said latch device includes manual means for disengaging said ferromagnetic rod from said socket.

15. The method for installing a self closing gate in a tensioned removable swimming pool fence comprising a plurality of poles interconnected by flexible mesh fencing comprising:

inserting a series of said plurality of poles into a deck surrounding a swimming pool with the flexible mesh fencing in tension to maintain the fence in tension;

the first and last poles of said series of poles defining a gate opening;

said first and last poles each constituting a pair of poles interconnected to each other to define a support structure capable of absorbing the tension of the flexible mesh fencing;

fabricating a gate including a pair of side rails, a cross rail and flexible mesh tensioned between said side rails;

hinging the first of said pair of side rails of said gate to the first of said pair of poles; and installing a latch between the second of said pair of side rails of said gate and said last pole of the tensioned fence;

whereby the gate is free to open and close without interference by the tension of the mesh of said fencing.

16. The method in accordance with claim 15 wherein said plurality of poles are removably secured to the pool deck by drilling holes at intervals sufficient to tension the mesh between adjacent poles and the deck and introducing the lower end of adjacent poles into successively drilled holes;

wherein the holes in the deck adjacent to the gate location are drilled at a slight vertical angle away from the direction of tension applied by the mesh fabric.

17. The method in accordance with claim 15 wherein the gate is installed by drilling a pair of holes on each side of the gate location, one for each pole of the pair of poles.

18. The method in accordance with claim 15 including securing the poles of each pair together to define a fencing tension absorbing support for the gate.

19. The method in accordance with claim 18 wherein the step of securing the poles of each pair together comprises attaching at least one rigid strap between poles.

* * * * *

UNITED STATES PATENT AND TRADEMARK OFFICE

CERTIFICATE OF CORRECTION

PATENT NO. : 5,664,769

DATED : September 9, 1997

INVENTOR(S) : Steven E. Sadinsky

It is certified that error appears in the above-identified patent and that said Letters Patent is hereby corrected as shown below:

On the title page item [73], change the spelling of the name of the assignee from: Stephen E. Sadinsky
to: Steven E. Sadinsky

Signed and Sealed this

Thirty-first Day of March, 1998

Bruce Lehman

*Attest:*

BRUCE LEHMAN

*Attesting Officer*

*Commissioner of Patents and Trademarks*